United States Patent [19]

Davidson

[11] Patent Number: 4,982,238

[45] Date of Patent: Jan. 1, 1991

[54] DEVELOPER MATERIAL MIXING APPARATUS FOR A DEVELOPMENT UNIT

[75] Inventor: James R. Davidson, Rochester, N.Y.

[73] Assignee: Xerox Corporation, Stamford, Conn.

[21] Appl. No.: 423,837

[22] Filed: Oct. 19, 1989

[51] Int. Cl.[5] ..... G03G 15/06

[52] U.S. Cl. ..... 355/260; 118/657; 118/658; 355/245; 355/251; 427/25; 430/122

[58] Field of Search ..... 355/245, 246, 251, 253, 355/260; 118/647, 651, 653, 656, 657, 658; 430/122; 427/25

[56] References Cited

U.S. PATENT DOCUMENTS

| | | | |
|---|---|---|---|
| 3,882,823 | 5/1975 | Tanaka et al. | 118/637 |
| 3,947,107 | 3/1976 | Smith . | |
| 3,999,514 | 12/1976 | Abbott et al. | 118/657 |
| 4,261,290 | 4/1981 | Yamashita et al. | 118/658 |
| 4,408,862 | 10/1983 | Takano et al. | 355/260 X |
| 4,480,911 | 11/1984 | Itaya et al. | 355/251 |
| 4,580,121 | 4/1986 | Ogawa | 355/251 X |
| 4,724,457 | 2/1988 | Abreu et al. . | |
| 4,841,330 | 6/1989 | Owada et al. | 355/245 |

FOREIGN PATENT DOCUMENTS

| | | | |
|---|---|---|---|
| 0104834 | 8/1979 | Japan | 355/245 |
| 0130773 | 10/1981 | Japan | 355/245 |
| 0199364 | 11/1983 | Japan | 355/245 |
| 0279375 | 12/1987 | Japan | 355/253 |

*Primary Examiner*—A. T. Grimley
*Assistant Examiner*—Thu Anh Dang
*Attorney, Agent, or Firm*—H. Fleischer; J. E. Beck; R. Zibelli

[57] ABSTRACT

An apparatus which develops an electrostatic latent image recorded on a photoconductive member with developer material of carrier granules and toner particles. A housing has a developing chamber and a mixing chamber. As toner particles are depleted during the printing process, additional toner particles are furnished to the mixing chamber. A mixing roller is located in the mixing chamber. An arcuate portion of the housing is closely adjacent to the mixing roller. An electrical bias is formed between the arcuate portion of the housing and the mixing roller. Toner particles charged to one polarity are attracted to the arcuate portion of the housing with toner particles charged to the opposite polarity being attracted to the mixing roller. As the mixing roller rotates, developer material is advanced to a receiving zone. The advancing developer material moves the toner particles attracted to the arcuate portion of the housing to the receiving zone. At the receiving zone, an auger transports the developer material to a loading zone where the developer material is received by another auger in the developing chamber. The auger in the developing chamber advances the developer material to a transport roll, which, in turn, moves the developer material to a developer roll. The developer roll transports the developer material closely adjacent to the photoconductive member having the electrostatic latent image recorded thereon. The latent image attracts toner particles thereto so as to be developed thereby.

10 Claims, 2 Drawing Sheets

DEVELOPER MATERIAL MIXING APPARATUS FOR A DEVELOPMENT UNIT

Figure 1:
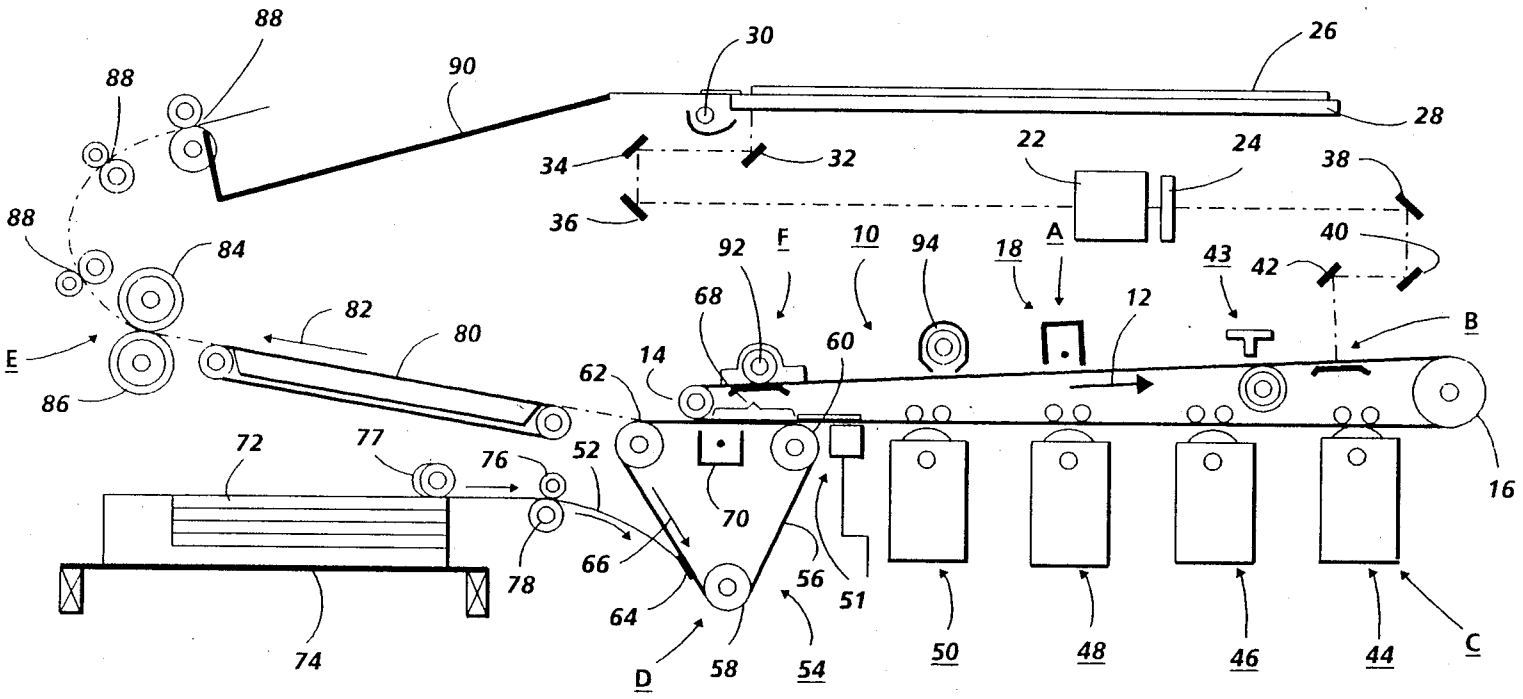

This invention was made with Government support under Government contract number USA-ETL-DACA 76-88-0009 awarded by the U.S. Army, Engineering Topographic Laboratory. The Government has certain rights in this invention.

This invention relates generally to an electrophotographic printing machine, and more particularly concerns a development unit having an improved developer material mixing system.

In an electrophotographic printing machine, the photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member which is subsequently transferred to a copy sheet. The copy sheet is heated to permanently affix the marking particles thereto in image configuration.

Various types of development systems have been commonly employed which utilize two component developer materials or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface the greater attractive force of the electrostatic latent image recorded thereon causes the toner particles to transfer from the carrier granules and adhere to the electrostatic latent image.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner particles of a color complimentary thereto. This process is repeated a plurality of cycles for differently colored images and their respective complimentarily colored toner particles. For example, a red filtered light image is developed with cyan toner particles, while a green filtered light image is developed with magenta toner particles and a blue filtered light image with yellow toner particles. Each single color toner power image is transferred to the copy sheet superimposed over the prior toner powder image. This creates a multi-layered toner powder image on the copy sheet. Thereafter, the multi-layered toner powder image is permanently affixed to the copy sheet creating a color copy. An illustrative electrophotographic printing machine for producing color copies is the Model No. 1005 made by the Xerox Corporation.

It is evident that in printing machines of this type, toner particles are depleted from the developer mixture. As the concentration of toner particles decreases, additional toner particles must be furnished to the developer unit to maintain the concentration of toner particles within the developer mixture in the developer housing at the required level. Previous developer housing designs have been deficient in both cross mixing, or uniformity of toner concentration across the width of the developer housing, and in admixing, or the electrostatic charge of the newly furnished toner particles. Various approaches have been used to provide mixing of the developer material. The following disclosures appear to be relevant:

U.S. Pat. No. 3,882,823: Patentee: Tanaka et al. Issued: May 13, 1975:

U.S. Pat. No. 3,947,107: Patentee: Smith Issued: Mar. 30, 1976:

U.S. Pat. No. 3,999,514: Patentee: Abbott et al. Issued: Dec. 28, 1976:

U.S. Pat. No. 4,261,290: Patentee: Yamashita et al. Issued: Apr. 14, 1989:

U.S. Pat. No. 4,724,457: Patentee: Abreu et al. Issued: Feb. 9, 1988.

The relevant portions of the foregoing patents may be briefly summarized as follows:

U.S. Pat. No. 3,882,823 discloses a toner dispenser located in the upper portion of a developer housing which discharges toner particles into the chamber of the housing. A rotary shaft having grooves cut in the surface thereof and made from a magnetic material is positioned adjacent a developer roller generating a magnetic field. The shaft is magnetized by the magnetic field from the developer roller and attracts developer material from the developer roller. The developer material is subsequently detached from the rotary shaft by centrifugal force and gravity after being sufficiently stirred and mixed with fresh toner from the toner dispenser.

U.S. Pat. No. 3,947,107 describes a pair of rotatably driven augers partially submerged in developer material receive toner particles from a toner dispenser and developer material returning from the development zone. The material is divided between the augers and transported in opposite directions. The developer material from the augers flows over and though a baffle and onto transport rollers which advance the mixed developer material to the developer rollers.

U.S. Pat. No. 3,999,514 discloses a pair of augers which mix and triboelectrically charge toner. A supply auger insures a uniform distribution along a brush roll.

U.S. Pat. No. 4,261,290 describes a developer roller located in the chamber of a developer housing transports developer material adjacent a photoconductive drum. Developer material returning form the development zone mixes with new toner being dispensed by a toner dispenser and flows through mixing chutes which convey the material across the centerline of the developer housing from one side to the other side to a transport roller which returns the material to the developer roller.

U.S. Pat. No. 4,724,457 discloses a developer housing having three chambers with an auger in each chamber. New toner is furnished to an auger located in a chamber at one end of the developer housing. The developer is advanced to successive augers and then to developer rollers. In this way, the developer material is gently mixed with the new toner.

Pursuant to the features of the present invention, there is provided an apparatus for mixing developer material having at least carrier granules and toner particles. The apparatus includes a housing defining a chamber storing a supply of developer material therein. Means are provided for advancing the developer material from a receiving zone to a loading zone in the chamber of the housing. Means, disposed in the chamber of the housing and having a region of the housing closely adjacent thereto, move at least a portion of the developer material to the receiving zone. The advancing means advances the developer material from the receiving zone to the loading zone. Means generate an electrical bias between the moving means and at least the region of the housing closely adjacent thereto. Toner particles charged to one polarity are attracted to the region of the housing closely adjacent to the moving means. Toner particles charged to the opposite polarity remain adhering to the moving means. The moving means move developer material with toner particles attracted to the region of the housing closely adjacent to the moving means being moved by the developer material moving with the moving means.

In accordance with another aspect of the present invention, there is provided an apparatus for developing a latent image recorded on a member by advancing a developer material of at least carrier granules and toner particles closely adjacent to the member so that toner particles are attracted to the latent image. The apparatus includes defining a mixing chamber and a developing chamber. Means, positioned, at least partially, in the developing chamber of the housing transport developer material closely adjacent to the member so that the latent image attracts toner particles thereto. Means, disposed in the mixing chamber of the housing, advance the developer material from a receiving zone to the transporting means at a loading zone. Means, disposed in the mixing chamber of the housing and having a region of the housing closely adjacent thereto, move at least a portion of the developer material to the receiving zone. At the receiving zone, the advancing means advances the developer material to the loading zone. Means are provided for generating an electrical bias between the moving means and at least the region of the housing closely adjacent thereto. Toner particles charged to one polarity are attracted to the region of the housing closely adjacent to the moving means. Toner particles charged to the opposite polarity remain adhering to the moving means. Toner particles attracted to the region of the housing closely adjacent to the moving means are moved by the developer material moving with the moving means.

Still another aspect of the present invention is an electrophotographic printing machine of the type in which an electrostatic latent image recorded on a photoconductive member is developed with developer material having at least carrier granules and toner particles. The improvement includes a housing defining a mixing chamber and a developing chamber. Means, positioned, at least partially, in the developing chamber of the housing transport developer material closely adjacent to the photoconductive member so that the electrostatic latent image recorded thereon attracts toner particles thereto. Means, disposed in the mixing chamber of the housing, advance the developer material from a receiving zone to the transporting means at a loading zone. Means, disposed in the mixing chamber of the housing and having a region of the housing closely adjacent thereto, move at least a portion of the developer material to the receiving zone. At the receiving zone, the advancing means advances the developer material to the loading zone. Means are provided for generating an electrical bias between the moving means and at least the region of the housing closely adjacent to the moving means. Toner particles charged to one polarity are attracted to the region of the housing closely adjacent to the moving means. Toner particles charged to the opposite polarity remain adhering to the moving means. Toner particles attracted to the region of the housing closely adjacent to the moving means are moved by the developer material moving with the moving means.

Figure 2:
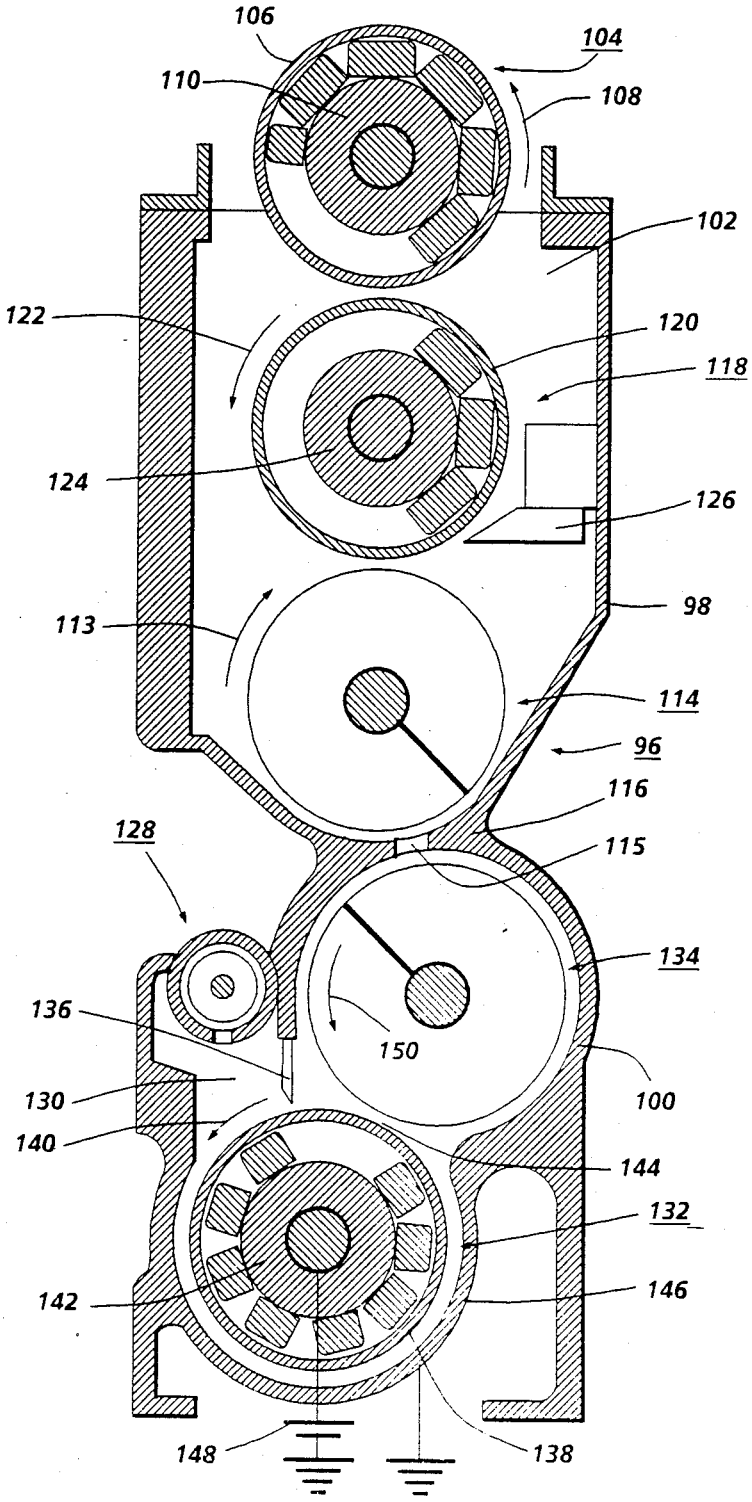

Other aspects of the present invention will become apparent as the following description proceeds and upon reference to the drawings, in which:

FIG. 1 is a schematic elevational view depicting an electrophotographic printing machine incorporating the development apparatus of the present invention therein; and FIG. 2 is a schematic elevational view showing the development apparatus used in the FIG. 1 printing machine.

While the present invention will herinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that the apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoreceptor, i.e. a photoconductive belt 10. Preferably, the photoconductive belt 10 is made from a photoconductive material coated on a grounding layer, which, in turn, is coated on an anticurl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, a corona generating device, indicated generally by the reference numeral 18 charges photoconductive belt 10 to a relatively high, substantially uniform potential.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are transmitted through filter 24 and reflected by mirrors 38, 40, and 42 on to the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image on the photoconductive belt corresponding to a specific color of the flowing light image of the original document. The electrostatic latent image recorded on the photoconductive surface of belt 10 is developed with toner particles at the development stations.

After the electrostatic latent image and test area have been recorded on photoconductive belt 10, belt 10 advances them to development station C. Development station C includes four individual developer units generally indicated by the reference numerals 44, 46, 48 and 50. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 44, 46, and 48, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 46 with blue absorbing (yellow) toner particles, while the red separation is developed by developer unit 48 with red absorbing (cyan) toner particles. Developer unit 50 contains black toner particles and may be used to develop the electrostatic latent image formed from a black and white original document. Each of the developer units is moved into and out of the operative position. In the operative position, the magnetic brush is closely adjacent the photoconductive belt, while, in the non-operative position, the magnetic brush is spaced therefrom. During development of each electrostatic latent image only one developer unit is in the operative position, the remaining developer units are in the non-operative position. This insures that each electrostatic latent image and successive test areas are developed with toner particles of the appropriate color without comingling. In FIG. 1, developer unit 44 is shown in the operative position with developer units 46, 48 and 50 being in the non-operative position. Inasmuch as each of the developer units are substantially identical, only the detailed structure of developer unit 44 will be described hereinafter with reference to FIG. 2.

After development, the toner image is moved to transfer station D where the toner image is transferred to a sheet of support material 52, such as plain paper amongst others. At transfer station D, the sheet transport apparatus, indicated generally by the reference numeral 54, moves sheet 52 into contact with photoconductive belt 10. Sheet transport 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper then closes securing the sheet thereto for movement therewith in a recirculating path. The leading edge of the sheet is secured releasably by gripper 64. As the belts move in the direction of arrow 66, the sheet 52 moves into contact with the photoconductive belt, in synchronism with the toner image developed thereon, at the transfer zone 68. A corona generating device 70 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging, exposing, developing, and transferring are repeated a plurality of cycles to form a multi-color copy of a colored original document.

After the last transfer operation, grippers 64 open and release sheet 52. Conveyor 80 transports sheet 52, in the direction of arrow 82, to fusing station E where the transferred image is permanently fused to sheet 52. Fusing station E includes a heated fuser roll 84 and a pressure roll 86. Sheet 52 passes through the nip defined by fuser roll 84 and pressure roll 86. The toner image contacts fuser roll 84 so as to be affixed to sheet 52. Thereafter, sheet 52 is advanced by forwarding roll pairs 88 to catch tray 90 for subsequent removal therefrom by the machine operator.

The last processing station in the direction of movement of belt 10, as indicated by arrow 12, is cleaning station F. A rotatably mounted fibrous brush 92 is positioned in cleaning station F and maintained in contact with photoconductive belt 10 to remove residual toner particles remaining after the transfer operation. Thereafter, lamp 94 illuminates photoconductive belt 10 to remove any residual charge remaining thereon prior to the start of the next successive cycle.

Referring now to FIG. 2, there is shown developer unit 44 in greater detail. Developer unit 44 includes a housing, indicated generally by the reference numeral 96. Housing 96 has a developing section 98 and a mixing section 100. Developing section 98 has a developing chamber 102. A developer roller, indicated generally by the reference numeral 104, is partially disposed in chamber 102 with a portion thereof extending slightly beyond developer chamber 102. Developer roller 104 transports developer material of magnetic carrier granules having toner particles adhering triboelectrically thereto closely adjacent to the photoconductive belt where the electrostatic latent image attracts toner particles thereto. Developer roller 104 has a tubular member 106 rotating in the direction of arrow 108. An elongated, stationarily mounted member 110 having magnetic poles impressed about a portion of the circumferential surface thereof, is located inside of and spaced from tubular member 106. As tubular member 106 rotates in the direction of arrow 108, the developer material moves therewith to develop the latent image. In a region having little or no magnetic field, i.e. where there are no magnetic poles, the used developer falls from tubular member 106 onto translating unit 114. Translating unit 114 has an auger partially enclosed by a semi-cylindrical member. The auger is a helical member adapted to rotate in the direction of arrow 113 so as to translate the developer material from one end to the other end thereof. Developing section 98 is separated from mixing section 100 by dividing wall 116. Dividing wall 116 has holes located at opposed ends thereof. Only one of these holes, i.e. hole 115 is shown. Hole 115 is located at one end of dividing wall 116. Developer material advances through hole 115 into mixing section 100 adjacent translating unit 114. This is the loading zone for furnishing developer material from the mixing section to the developing section. The used developer material falls from translating unit 114 into mixing section 100 through the other hole (not shown) located at the other end of dividing wall 116. Translating unit 114 also moves the developer material to a transport roller, indicated generally by the reference numeral 118. Transport roller 118 has a tubular member 120 rotating in the direction of arrow 122. An elongated, stationarily mounted member 124 having magnetic poles impressed about a portion of its exterior circumferential surface is disposed inside tubular member 120. A blade 126 has the free end thereof spaced from tubular member 120 to define a gap therebetween. Developer material is attracted from translating unit 114 to tubular member 120. As tubular member 120 rotates in the direction of arrow 122, blade 126 shears extraneous developer material from tubular member 120 of transport roll 118. In this way, a continuous supply of developer material is metered to developer roller 104 for advancement to the latent image recorded on the photoconductive belt. Developer material retained on tubular member 120 is released therefrom in a region substantially devoid of magnetic fields, i.e. a region having no magnetic poles impressed thereon shown near the top of transport roller 118. Upon being released from tubular member 120, the developer material is magnetically attracted to developer roller 104 and carried to the developing zone closely adjacent to the latent image recorded on the photoconductive belt.

Turning now to mixing section 100, a toner dispenser, indicated generally by the reference numeral 128 discharges toner particles into mixing chamber 130. Toner dispenser 128 has a helical auger disposed in a tube coupled to a toner container storing a supply of toner particles. The tube has an opening to discharge toner particles being moved therealong by the auger into the mixing chamber 130. The part of the developer material that falls from translating unit 114 is carried by roll 132 to the end of mixing chamber 130 where toner particles are being discharged from toner dispenser 128. A control system, which measures the concentration of toner particles in the developer material, regulates the dispensing of toner particles into mixing chamber 130. Part of the developer material and new toner particles fall onto a mixing roller, indicated by the reference numeral 132. Another part of the developer material remains in a translating unit, indicated by the reference numeral 134. A metering blade 136 has the free end thereof spaced from mixing roller 132 to define a gap therebetween. Metering blade 136 regulates the quantity of developer material being transported by mixing roller 132 in mixing chamber 130. Mixing roller 132 includes a sleeve 138 rotating in the direction arrow 140. An elongated member 142 having magnetic poles impressed about a portion of its exterior surface, is mounted stationarily inside sleeve 140. Mixing roller 132 is positioned adjacent translating unit 134. Elongated member 142 is oriented so that receiving zone 144 has a weak or substantially no magnetic field thereat. There are no magnetic poles on elongated member 142 in the vicinity of receiving zone 144. Sleeve 138 of mixing roller 132 is located closely adjacent an arcuate portion 146 of mixing section 100. A voltage source 148 electrically biases sleeve 138 to a selected magnitude and polarity. Arcuate portion 146 of mixing section 100 is electrically grounded. As the developer material is transported by sleeve 138 in the direction of arrow 140, the electrical bias between sleeve 138 and arcuate portion 146 will cause toner particles charged to one polarity to migrate preferentially toward arcuate portion 146. Toner particles attracted to arcuate portion 146 will be carried along by the carrier granules moving with sleeve 138 and lightly wiping the surface of arcuate portion 146. Toner particles charged to an opposite polarity will be urged toward sleeve 138. These oppositely or wrongly charged toner particles will be retained on sleeve 138 of mixing roller 132 until they reverse their charge, i.e. become rightly charged, by mechanical agitation. By this mechanism, correctly charged toner particles tend to be carried into receiving zone 144 with incorrectly charged toner particles being retained in mixing chamber 130. Due to the proximity of the mixing roller 132 and translating unit 134, part of the developer material is carried along the length of the housing and part is circulated through mixing chamber 130. In this manner, the developer material is continually intermixed so that all, or most of the developer material containing new toner particles circulated through the mixing chamber before being carried from one end to the other end of the housing by translating unit 134.

At receiving zone 144 the developer material is received by translating unit 134. Translating unit 134 includes a helical auger mounted rotatably in an enclosure. The enclosure includes a semi-cylindrical portion extending outwardly from one end of a tube having the other end closed. The auger rotates in the direction of arrow 148, i.e. in the opposite direction to the direction of rotation of the auger of translating unit 114. The tube is located at the far end of the mixing chamber 130 and has an opening in the region thereof adjacent translating unit 114 at loading zone 116. The pressure of the advancing developer material forces developer material through hole 115 in dividing wall 116 into developing chamber 102 at the loading zone. The developer material moving through hole 115 is loaded in translating unit 114. By the time the developer material reaches the far end of the mixing chamber 130, all of the developer material will have passed around mixing roller 132 several times, as well as being agitated by translating unit 134. In this way, a uniformly blended and well charged mixture of developer material will be delivered to translating unit 114 in developing section 98.

In recapitulation, the developer unit of the present invention has a housing with a developing section and a mixing section. The developer material is mixed and charged with wrongly charged toner particles being retained in the mixing section while correctly charged toner particles are advanced to the developing section.

It is, therefore, evident that there has been provided in accordance with the present invention, a development system that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing a latent image recorded on a member by advancing a developer material of at least carrier granules and toner particles closely adjacent to the member so that toner particles are attracted to the latent image, including:

a housing defining a mixing chamber and a developing chamber;

means, positioned, at least partially, in the developing chamber of said housing, for transporting developer material closely adjacent to the member so that the latent image attracts toner particles thereto;

means, disposed in the mixing chamber of said housing, for advancing the developer material from a receiving zone to a loading zone where the developer material is received by said transporting means, said advancing means includes an enclosure comprising a tubular portion positioned at least partially at the loading zone and a semi-cylindrical portion extending from one end of the tubular portion and positioned at least partially in the receiving zone, and an auger mounted internally of said enclosure and being adapted to advance the developer material and toner particles from the semi-cylindrical portion to the tubular portion;

means, disposed in the mixing chamber of said housing and having a region of said housing closely adjacent thereto, for moving at least a portion of the developer material to the receiving zone so that said advancing means advances the developer material to the loading zone;

means for generating an electrical bias between said moving means and at least the region of said housing closely adjacent thereto so that toner particles charged to one polarity are attracted to the region of said housing closely adjacent thereto with toner particles charged to the opposite polarity remaining adhering to said moving means, said moving means moving developer material with toner particles attracted to the region of said housing closely adjacent to said moving means being moved by the developer material moving with said moving means;

means for regulating the quantity of developer material being moved by said moving means; and means for dispensing toner particles into the mixing chamber of said housing.

2. An apparatus according to claim 1, wherein said moving means includes:

a rotatably mounted sleeve; and an elongated magnetic member disposed interiorly of said sleeve to attract to the exterior surface of said sleeve magnetic carrier granules having toner particles adhering triboelectrically thereto.

3. An apparatus according to claim 2, wherein said regulating means includes a blade having the free end thereof spaced from said sleeve to define a gap therebetween.

4. An apparatus according to claim 3, wherein said transporting means includes:

means for receiving developer material from said advancing means at the loading zone and moving the developer material in an opposite direction to the direction that said advancing means moves the developer material;

a transport roll adapted to receive developer material from said advancing and receiving means; and a developer roll adapted to receive developer material from said transport roll and arranged to move the developer material closely adjacent to the member.

5. An apparatus according to claim 4, further including means for controlling the quantity of developer material being transported by said transport roll to said developer roll.

6. An electrophotographic printing machine of the type in which an electrostatic latent image recorded on a photoconductive member is developed with developer material having at least carrier granules and toner particles, wherein the improvement includes:

a housing defining a mixing chamber and a developing chamber;

means, positioned, at least partially, in the developing chamber of said housing for transporting developer material closely adjacent to the photoconductive member so that the electrostatic latent image recorded thereon attracts toner particles thereto;

means, disposed in the mixing chamber of said housing, for advancing the developer material from a receiving zone to a loading zone where the developer material is received by said transporting means said advancing means includes an enclosure comprising a tubular portion positioned at least partially at the loading zone and a semi-cylindrical portion extending from one end of the tubular portion and positioned at least partially in the receiving zone, and an auger mounted internally of said enclosure and being adapted to advance the developer material and toner particles from the semi-cylindrical portion to the tubular portion;

means, disposed in the mixing chamber of said housing and having a region of said housing closely adjacent thereto, for moving at least a portion of the developer material to the receiving zone so that said advancing means advances the developer material to the loading zone; and means for generating an electrical bias between said moving means and at least the region of said housing closely adjacent thereto so that toner particles charged to one polarity are attracted to the region of said housing closely adjacent thereto with toner particles charged to the opposite polarity remaining adhering to said moving means, said moving means moving developer material with toner particles attracted to the region of said housing closely adjacent to said moving means being moved by the developer material moving with said moving means;

means for regulating the quantity of developer material being moved by said moving means; and means for dispensing toner particles into the mixing chamber of said housing.

7. A printing machine according to claim 6, wherein said moving means includes:

a rotatably mounted sleeve; and an elongated magnetic member disposed interiorly of said sleeve to attract to the exterior surface of said sleeve magnetic carrier granules having toner particles adhering triboelectrically thereto.

8. A printing machine according to claim 7, wherein said regulating means includes a blade having the free end thereof spaced from said sleeve to define a gap therebetween.

9. A printing machine according to claim 8, wherein said transporting means includes:

means for receiving developer material from said advancing means at the loading zone and moving the developer material in an opposite direction to the direction that said advancing means moves the developer material;

a transport roll adapted to receive developer material from said advancing and receiving means; and a developer roll adapted to receive developer material from said transport roll and arranged to move the developer material closely adjacent to the member.

10. A printing machine according to claim 9, further including means for controlling the quantity of developer material being transported by said transport roll to said developer roll.

* * * * *